US010161077B2

(12) United States Patent
Lee

(10) Patent No.: US 10,161,077 B2
(45) Date of Patent: Dec. 25, 2018

(54) WASHING MACHINE AND LIQUID ADDITIVE SUPPLY DEVICE FOR THE SAME

(71) Applicant: Dongbu Daewoo Electronics Corporation, Seoul (KR)

(72) Inventor: Jong Jin Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 112 days.

(21) Appl. No.: 15/287,541

(22) Filed: Oct. 6, 2016

(65) Prior Publication Data

US 2017/0233933 A1 Aug. 17, 2017

(30) Foreign Application Priority Data

Feb. 15, 2016 (KR) ..... 10-2016-0017461

(51) Int. Cl.

| | |
|---|---|
| ***D06F 39/02*** | (2006.01) |
| ***D06F 39/08*** | (2006.01) |
| ***D06F 39/10*** | (2006.01) |
| ***D06F 37/02*** | (2006.01) |
| ***D06F 39/00*** | (2006.01) |

(52) U.S. Cl.

CPC ..... *D06F 39/022* (2013.01); *D06F 37/02* (2013.01); *D06F 39/005* (2013.01); *D06F 39/088* (2013.01); *D06F 39/10* (2013.01)

(58) Field of Classification Search

CPC ..... D06F 39/02; D06F 39/022; D06F 39/005; D06F 39/088; D06F 39/10

See application file for complete search history.

(56) References Cited

U.S. PATENT DOCUMENTS

| | | | | |
|---|---|---|---|---|
| 2,991,911 A * | 7/1961 | Spain | A47L 15/4445 | 137/134 |
| 3,595,438 A * | 7/1971 | Daley | A47L 15/4436 | 222/67 |
| 4,826,661 A * | 5/1989 | Copeland | A47L 15/4436 | 134/93 |
| 2010/0000022 A1* | 1/2010 | Hendrickson | D06F 39/02 | 8/137 |
| 2010/0000025 A1* | 1/2010 | Dalton | A47L 15/44 | 8/137 |

(Continued)

FOREIGN PATENT DOCUMENTS

WO WO-2015008912 A1 * 1/2015 ..... D06F 39/022

OTHER PUBLICATIONS

Machine translation of WO-2015008912-A1 to Kim et al. (Year: 2015).*

*Primary Examiner* — Joseph L. Perrin

(57) ABSTRACT

A washing machine with a liquid additive supply device capable of sensing an amount of liquid additive contained therein. A buoyancy body and a sensing unit are disposed in a reservoir tank of the liquid additive supply device. The vertical position and therefore the distance between the buoyancy body and a sensing unit vary with the surface level of liquid additive in the reservoir tank due to buoyancy effect. The buoyancy body may include a magnetic body and the sensing unit can detect the intensity of the magnetic body. The surface level of the liquid additive is too low, the sensing unit can generate a signal indicative of liquid additive shortage.

15 Claims, 8 Drawing Sheets

(56) References Cited

U.S. PATENT DOCUMENTS

| | | | | |
|---|---|---|---|---|
| 2010/0000578 | A1* | 1/2010 | Hendrickson | D06F 39/022 134/34 |
| 2011/0153871 | A1* | 6/2011 | Ferragut, II | F24C 7/082 710/8 |
| 2012/0037659 | A1* | 2/2012 | Hagleitner | A47K 5/1207 222/39 |
| 2012/0090361 | A1* | 4/2012 | Greger | D06F 39/02 68/13 R |
| 2012/0174632 | A1* | 7/2012 | Sung | D06F 39/022 68/17 R |
| 2016/0215434 | A1* | 7/2016 | Doyle | D06F 39/02 |
| 2016/0258106 | A1* | 9/2016 | Kim | D06F 39/022 |

* cited by examiner

WASHING MACHINE AND LIQUID ADDITIVE SUPPLY DEVICE FOR THE SAME

CROSS-REFERENCE TO RELATED APPLICATION

This application is based on and claims priority from Korean Patent Application No. 10-2016-0017461, filed on Feb. 15, 2016, the disclosure of which is incorporated herein in its entirety by reference for all purposes.

TECHNICAL FIELD

Embodiments of the present disclosure relate to washing machines, and, more particularly, to liquid additive supply devices for washing machines.

BACKGROUND

Washing machines are commonly used to wash laundry or other objects by using friction between water and the laundry in combination with emulsification of detergent. A modern automatic washing machine is capable of automatically performing washing, rinsing and dewatering in an integrated process once it is started.

Depending on the type of the washing tub used for containing laundry, washing machines may be classified into types including a top-loading type (in which a washing tub is upright) and a drum type (in which a washing tub is positioned horizontal). As compared with the top-loading type, a drum type washing machine generally has reduced overall height and increased washing capacity and causes less fabric twist. Thus, the drum type washing machine has become more popular.

A washing machine typically has a detergent supply device for dispensing detergent during a washing cycle. The amount of detergent to be dispensed may depend on the laundry load. When supplying washing water into a tub, the detergent supply device supplies detergent to the tub where water is also supplied, the detergent being solid-phase (e.g., powder) or liquid-phase, etc. The detergent dispensing systems in washing machines may have quite different configurations depending what kind of detergent can be used.

In a washing machine using powder detergent, the detergent supply device can only be installed in the upper portion of the tub as it would not be easy to move powder detergent upward if it was added at a lower position. In contrast, a washing machine using liquid detergent has no such limitation because liquid detergent loaded at a lower position can be brought upward by using a pump or the like. For example, in a washing machine using liquid detergent, a detergent supply device may be installed under a tub.

Liquid detergent is easily diluted in washing water and outperforms powder detergent in emulsification. Thus, liquid detergent is widely used. A detergent supply device in a washing machine may include a reservoir tank capable of storing liquid detergent. Since it is difficult for a user to directly see the level of liquid detergent in the reservoir tank, a level sensor can be used in the detergent supply device to ensure adequate liquid detergent for a washing operation.

According to a conventional washing machine, if liquid detergent is above a predetermined level in the reservoir tank, a level sensor is electrically conducted by the liquid detergent. If the liquid detergent is below the predetermined level, electric conductivity of the level sensor is cut off.

Thus, a warning of shortage of liquid detergent may be sent to a user based on the conductivity of an electrode.

However, contact between the level sensor and liquid detergent likely causes corrosion and rust on the electrode. A level sensor in the conventional detergent supply device tends to suffer reduced sensing ability and accuracy due to scale accumulation on the electrode.

PRIOR ART DOCUMENTS

Patent Documents

Patent Document: Korean Patent Application Publication No. 10-2006-0000001 (published on Jan. 6, 2006)

SUMMARY

Embodiments of the present disclosure provide a liquid additive supply device used on a washing machine, which is capable of reliably and accurately sensing a surface level of liquid additive left in the liquid additive supply device. Accordingly, shortage of liquid additive in the storage tank can be detected and informed to a user.

According to one embodiment of the present disclosure, a liquid additive supply device includes: a reservoir tank configured to store a liquid additive; a buoyancy body installed in the reservoir tank so that the vertical position of the buoyancy body varies with the surface level of the liquid additive; a sensor unit installed at one side of the reservoir tank in a position facing the buoyancy body and configured to sense its distance from the buoyancy body; a control unit configured to receive a signal from the sensor unit and to determine shortage of the liquid additive; and a display unit configured to receive a control signal from the control unit and to notify shortage of the liquid additive to a user.

As the sensing unit senses the amount of liquid additive left in the reservoir tank in a non-contact manner, sensing ability and accuracy can be maintained despite scale accumulation on the sensing unit.

The buoyancy body may include a buoy portion in which buoyancy force is exerted; and a lever arm coupled to the buoy portion and hingedly coupled to one side of the reservoir tank so that the buoy portion can pivot as the surface level of the liquid additive changes.

A magnetic body may be installed within the buoy portion. The sensor unit may sense a magnetic field of the magnetic body and so sense the approach of the buoyancy body without directly contacting the buoy portion.

The buoy portion may include: a magnetic body inside the buoy portion in a position facing the sensor unit and configured to generate a magnetic field; and an air chamber formed inside the buoy portion to increase the buoyancy effect.

The display unit may include at least one of an alarm and a flickering monitor.

According to another embodiment of the present disclosure, a washing machine includes: a drum configured to accommodate a washing object; a washing water supply unit configured to supply washing water into the drum; and a liquid additive supply device configured to supply a liquid additive into the drum, wherein the liquid additive supply device includes a reservoir tank configured to store the liquid additive; a buoyancy body installed in a lower portion of the reservoir tank so that the height of the buoyancy body is variable with a surface level of the liquid additive in the reservoir tank; a sensor unit installed at one side of the reservoir tank in a position facing the buoyancy body and configured to sense approach of the buoyancy body; a control unit configured to receive a signal from the sensor unit and to determine shortage of the liquid additive; and a display unit configured to receive a control signal from the control unit and to notify the shortage of the liquid additive.

Embodiments of the present disclosure allow accurate sensing of a surface level of (and therefore the amount of) a liquid additive left in a reservoir tank in a washing machine. Degradation in the sensing ability and erroneous operations can be effectively prevented even when the washing machine is used for a long period of time.

DETAILED DESCRIPTION

Figure 1A:
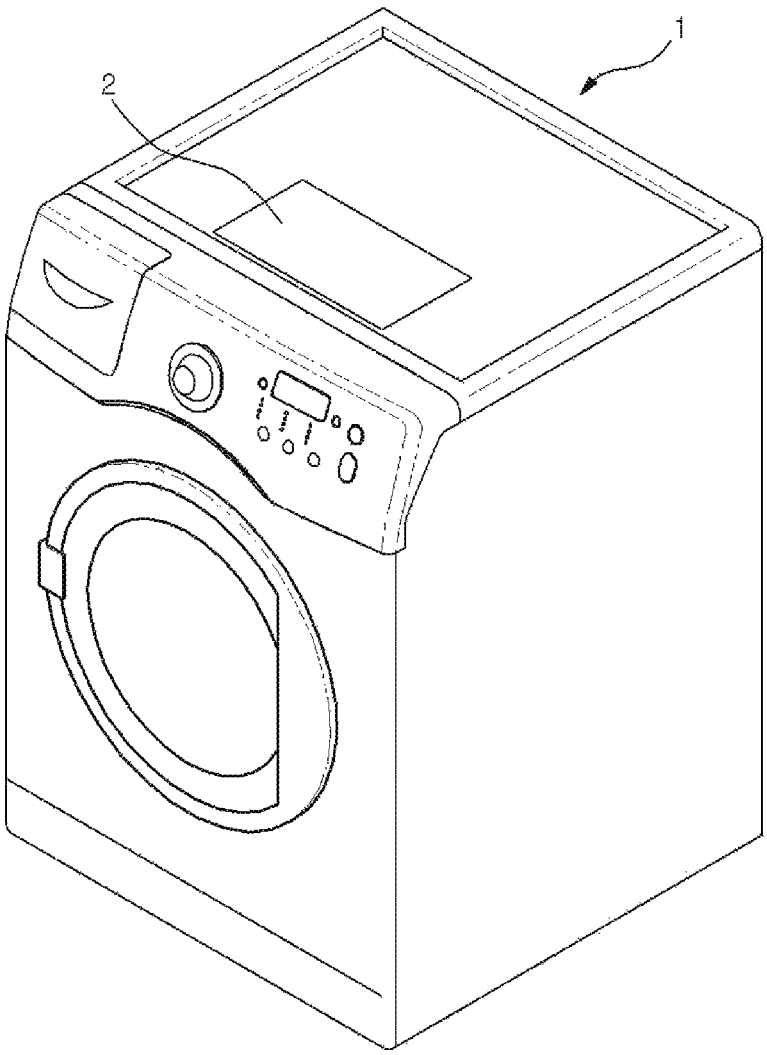
FIG. 1A illustrates an exemplary washing machine including a liquid additive supply device according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

The configuration and operation according to one embodiment of the present disclosure will now be described in detail with reference to the accompanying drawings.

Figure 1B:
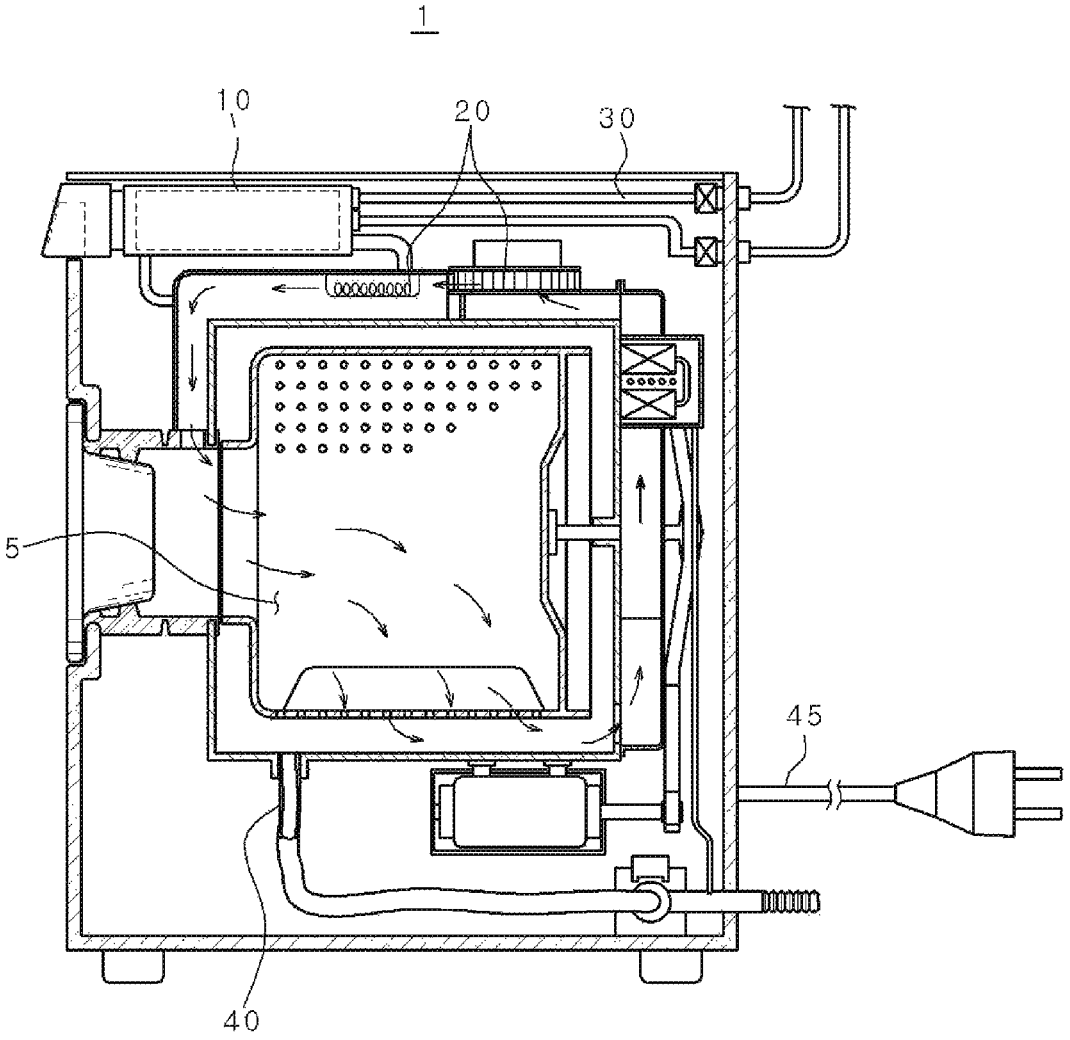
FIG. 1B illustrates the configuration of the washing machine illustrated in FIG. 1A.
Figure 2:
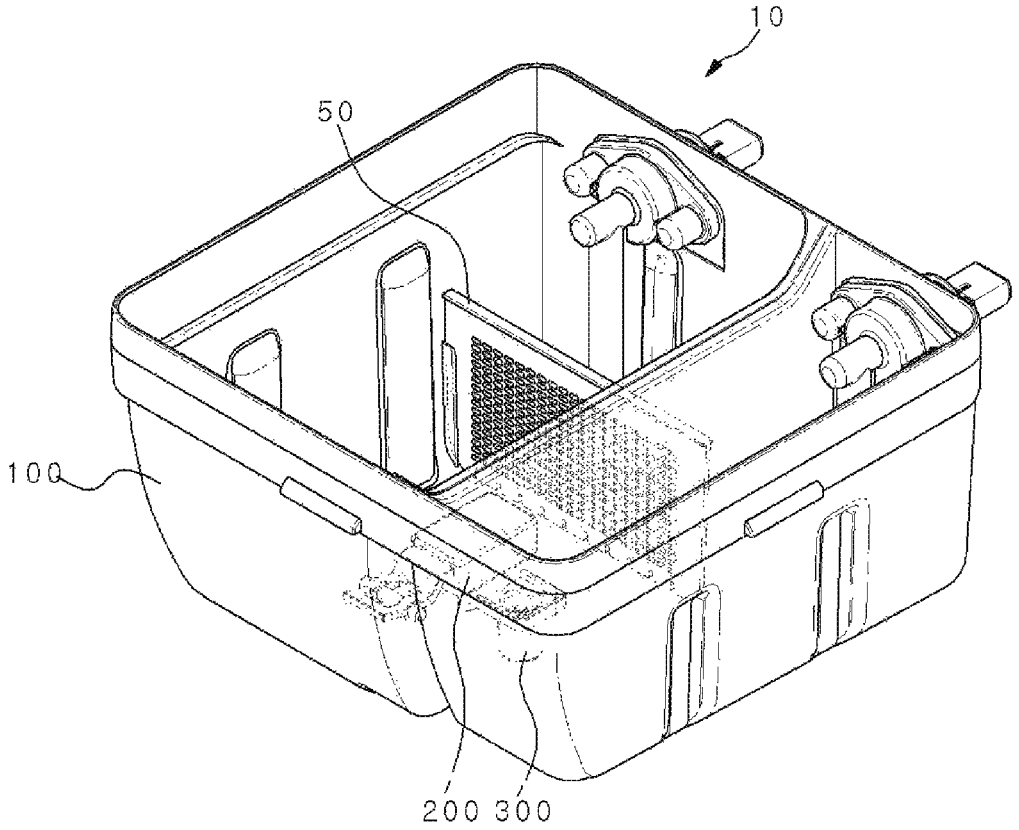
FIG. 2 illustrates a perspective view of an exemplary liquid additive supply device according to one embodiment of the present disclosure.
Figure 3:
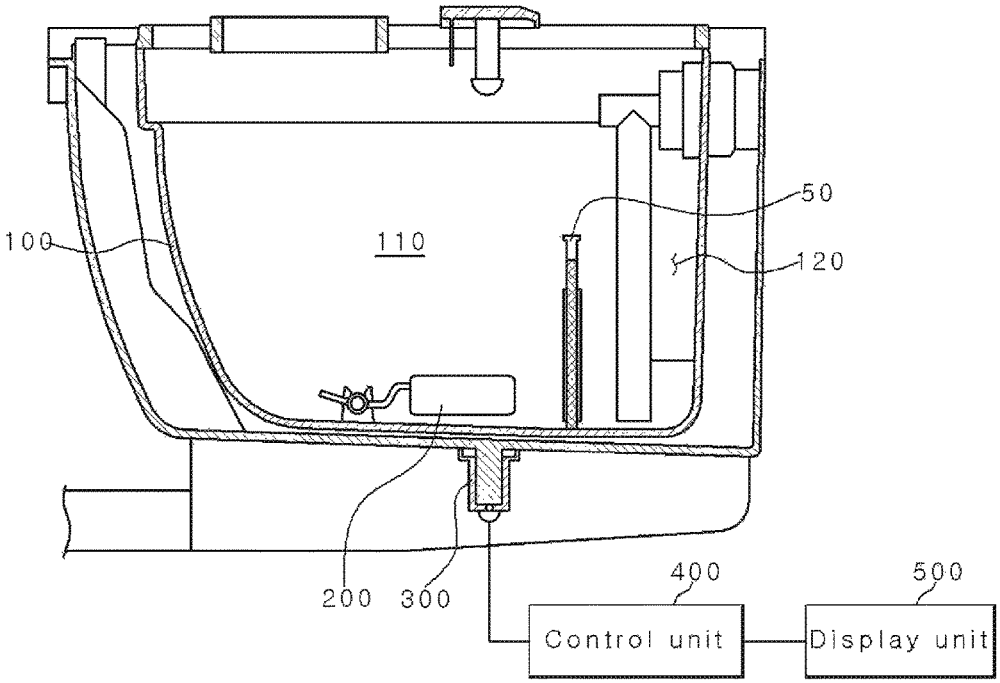
FIG. 3 illustrates a configuration of the exemplary liquid additive supply device according to one embodiment of the present disclosure.

FIG. 1A illustrates an exemplary washing machine including a liquid additive supply device according to one embodiment of the present disclosure. FIG. 1B illustrates the configuration of the washing machine illustrated in FIG. 1A. FIG. 2 illustrates a perspective view of an exemplary liquid additive supply device according to one embodiment of the present disclosure. FIG. 3 illustrates the configuration of the exemplary liquid additive supply device according to one embodiment of the present disclosure.

Referring first to FIG. 1A, the drum type washing machine 1 includes a liquid additive supply device 10 capable of storing a liquid additive such as detergent or fabric softener. The liquid additive supply device 10 may be installed in the front upper portion of the washing machine 1. FIG. 1A illustrates that the liquid additive supply device 10 is covered by a cover 2.

Liquid additive can be supplied from the liquid additive supply device 10 to the tub in the washing machine during a washing process. The drum type washing machine 1 may store not only liquid but also powder additive.

As illustrated in FIG. 1B, the drum type washing machine 1 may include: a drum 5; a drying device 20 configured to dry a washing object contained in the drum 5; a washing water supply unit 30 configured to supply washing water to the drum 5; a washing water drain part 40 configured to drain the washing water therethrough; an electricity supply device 45 configured to supply electric power to the washing machine 1; and a liquid additive supply device 10 configured to supply a liquid additive for use in washing the washing object.

The drum 5 is coupled to the drying device 20 and the washing water supply unit 30. During a drying process, drying air may be supplied from the drying device 20. During a washing process, washing water is supplied from the washing water supply unit 30. Washing water contained in the drum 5 may be drained through the washing water drain part 40.

The drying device 20 may dry the laundry contained in the drum 5. The drying device 20 may include: a circulation device configured to circulate air inside the drum 5; an exhaust part configured to exhaust air from the drum 5; and a heater configured to heat air inside the drum 5.

The washing water supply unit 30 may supply the washing water from the outside into the drum 5. The washing water supply unit 30 may be coupled to the liquid additive supply device 10. Washing water can be supplied from the washing water supply unit 30 to the drum 5 via the liquid additive supply device 10. The washing water supply unit 30 may include, for example, a pipe or a hose in the upper portion of the washing machine 1.

The washing water drain part 40 may allow washing water discharged from the drum 5 to be drained to the outside of the washing machine 1. The electricity supply device 45 may supply electric power to the washing machine 1.

The liquid additive supply device 10 is used to store a liquid additive which can be mixed with washing water and supplied to the drum 5. The liquid additive supply device may include multiple compartments, e.g., for storing liquid detergent, powder detergent and fabric softener separately.

Referring to FIGS. 2 and 3, the liquid additive supply device 10 for a washing machine according to one embodiment of the present disclosure may include a reservoir tank 100, a buoyancy body 200, a sensor unit 300, a control unit 400 and a display unit 500.

It will be appreciated that the liquid additive supply device 10 may include any other component without departing from the scope of the present disclosure, e.g., well-known components of a liquid additive supply device. The well-known components are not described herein for brevity.

The reservoir tank 100 may contain a liquid additive such as detergent or fabric softener. As illustrated in FIG. 2, the reservoir tank 100 may be divided into a plurality of compartments to store different additives (e.g., detergent and fabric softener). The compartments may have different sizes. The compartments may have different or similar configurations. In the embodiment described herein, the compartments have the same structure and thus same reference numerals and component names are used herein.

When using the washing machine 1, a user may select through a user interface the kind of liquid additive for a washing operation. For instance, if liquid additive is selected through the selection keys disposed on an outer wall of the washing machine 1, a washing operation is started with a suction pump being activated and washing water being supplied to the tub. Through the suction pump, the liquid additive stored in the reservoir tank 100 can be supplied to the tub.

The buoyancy body 200 and the sensor unit 300 are used to sense the surface level of the liquid additive. A user may be notified of the shortage of the liquid additive as sensed by the buoyancy body 200 and the sensor unit 300. The buoyancy body 200 may be installed in the lower portion of the reservoir tank 100. The vertical position of the buoyancy body 200 varies with the amount of the liquid additive left due to buoyancy effect generated by the liquid additive.

The reservoir tank 100 may be partitioned and divided into a first tank 110 and a second tank 120 by a filter unit 50. In this case, the buoyancy body 200 may be installed in the lower portion of the first tank 110 and may move up and down with the level of the liquid additive.

The sensor unit 300 may be installed on one side of the reservoir tank 100 and faces the buoyancy body 200. If the sensor unit 300 senses the buoyancy body 200 approaching, it outputs a predetermined signal.

The control unit 400 may receive the signal from the sensor unit 300 and determine a shortage of the liquid additive. The display unit 500 may receive a control signal from the control unit 400 and display a message indicating liquid additive shortage.

Hereinafter, the present embodiment will be described in more detail with reference to FIGS. 4, 5 and 6.

Figure 4:
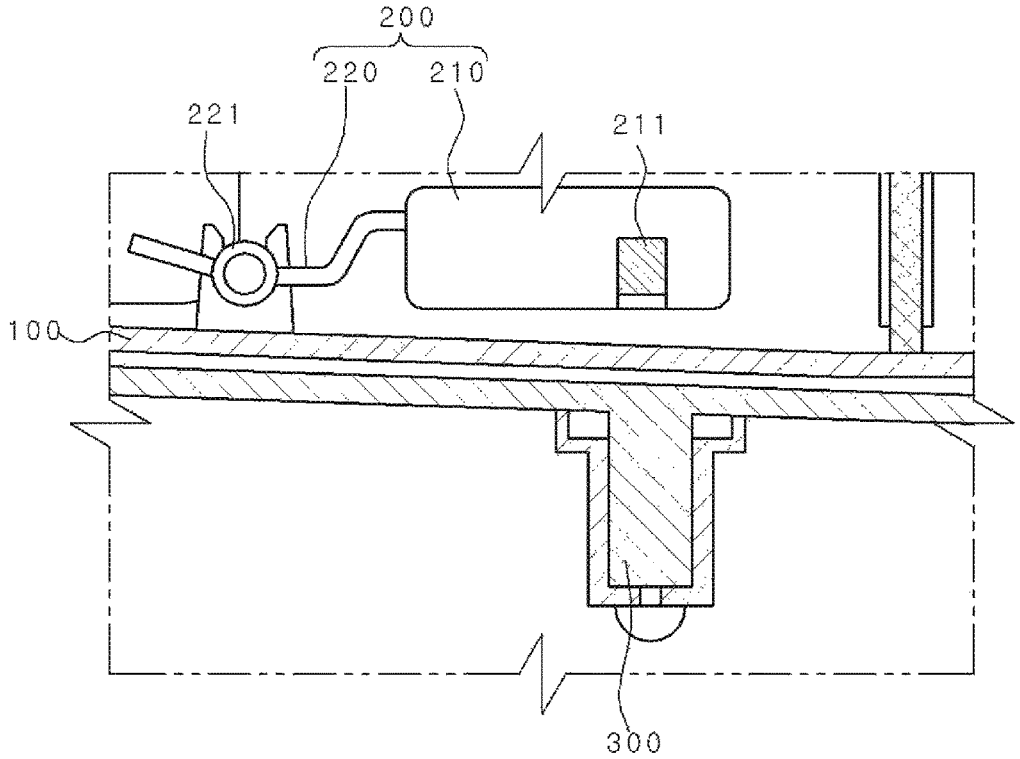
FIG. 4 illustrates configurations of an exemplary buoyancy body and an exemplary sensor unit of the liquid additive supply device according to one embodiment of the present disclosure.

FIG. 4 illustrates the configurations of an exemplary buoyancy body and an exemplary sensor unit of the liquid additive supply device according to one embodiment of the present disclosure. FIG. 5 illustrates the structure of a buoy portion of the exemplary buoyancy body. FIG. 6 illustrates an exemplary display unit of the liquid additive supply device according to one embodiment of the present disclosure.

Figure 5:
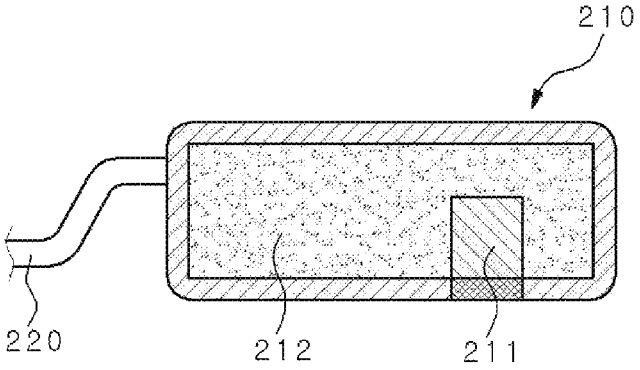
FIG. 5 illustrates a structure of a buoy portion of the exemplary buoyancy body.

As illustrated in FIGS. 4 and 5, the buoyancy body 200 may include a buoy portion 210 and a lever arm 220. The buoy portion 210 can be lifted by the liquid additive. The lever arm 220 may be coupled to the buoy portion 210 and to one side of the reservoir tank 100 through a hinge 221 on which the buoy portion 210 can pivot.

A magnetic body 211 that generates a magnetic field may be installed within the buoy portion 210. The sensor unit 300 may sense the magnetic field generated by the magnetic body 211. Thereby, the sensor unit 300 can detect the approach of the buoyancy body 200 in a non-contact manner.

In this way, the buoyancy body 200 and the sensor unit 300 keep spaced apart from each other so that the sensor unit 300 can sense any liquid additive shortage in a non-contact manner. Thus, even if scale builds up on the buoyancy body 200, sensing ability and accuracy will not be affected. This advantageously enhances the reliability.

Furthermore, as illustrated in FIG. 5, the buoy portion 210 may include a magnetic body 211 and an air chamber 212. The magnetic body 211 is installed within the buoy portion 210 and enclosed. The magnetic body 211 may be disposed within the buoy portion 210 in a position facing the sensor unit 300 and may generate a magnetic field. As a result, if the buoy portion 210 moves toward the sensor unit 300 and is located within a predetermined range, the sensor unit 300 senses the magnetic field of the magnetic body 211 without directly contacting the buoy portion 210.

As illustrated in FIG. 5, the air chamber 212 may be formed within the buoy portion 210 and filled with air to increase the buoyancy effect.

Figure 6:
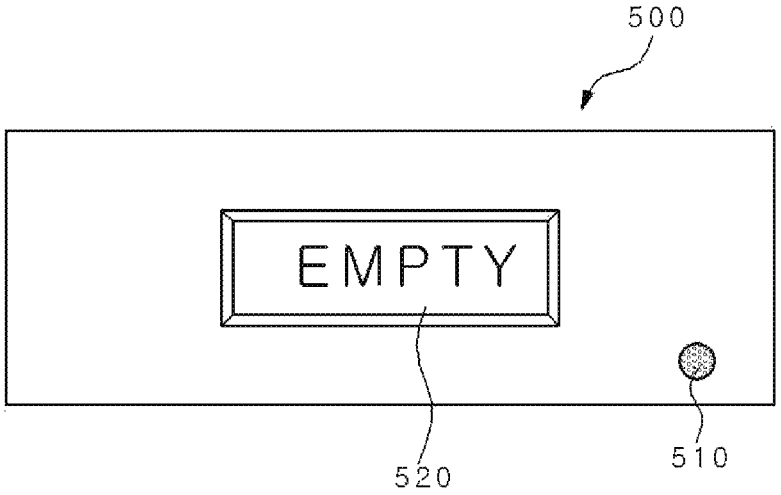
FIG. 6 illustrates an exemplary display unit of the liquid additive supply device according to one embodiment of the present disclosure.

As illustrated in FIG. 6, the display unit 500 may include at least one of an alarm 510 and a flickering monitor 520 which can receive a control signal from the control unit 400 and accordingly generate a user message about the shortage of the liquid additive. More specifically, if the liquid additive contained in the reservoir tank 100 is deficient and the level of the liquid additive is lowered, the buoy portion 210 moves toward the sensor unit 300. The sensor unit 300 senses the magnetic field of the magnetic body 211 installed within the buoy portion 210 and outputs a corresponding signal to the control unit 400. At this time, the control unit 400 sends a control signal to the display unit 500. The display unit 500 may include one or both of the alarm 510 and the monitor 520 to generate a message to a user.

Hereinafter, the operation of the present embodiment will be briefly described with reference to FIGS. 7 and 8.

Figure 7:
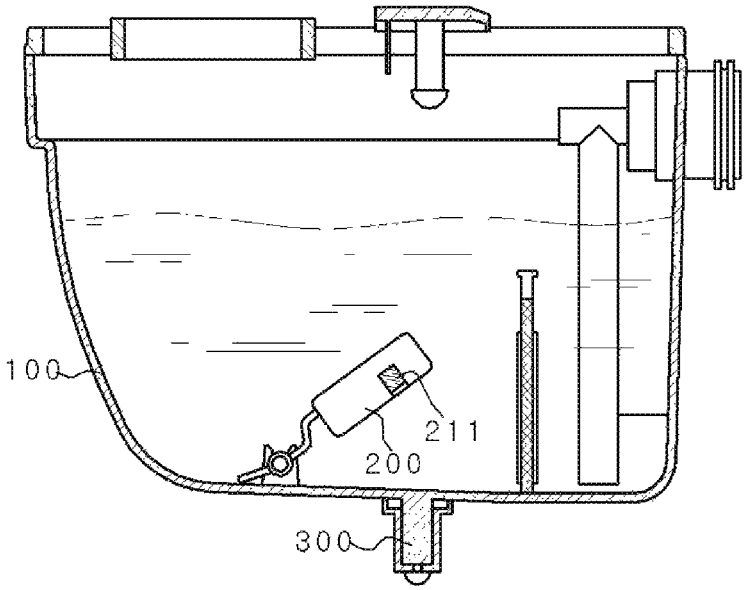
FIGS. 7 and 8 illustrate operational states of the exemplary liquid additive supply device according to one embodiment of the present disclosure.

As illustrated in FIG. 7, if the liquid additive is adequate in the reservoir tank 100, the buoyancy body 200 moves up by a buoyancy force. As a result, the magnetic body 211 installed within the buoyancy body 200 is spaced apart from the sensor unit 300. Thus, the sensor unit 300 senses a weak magnetic field or cannot sense the magnetic body 211 at all. Accordingly, the control unit 400 can determine that there is enough liquid additive present within the reservoir tank 100.

Figure 8:
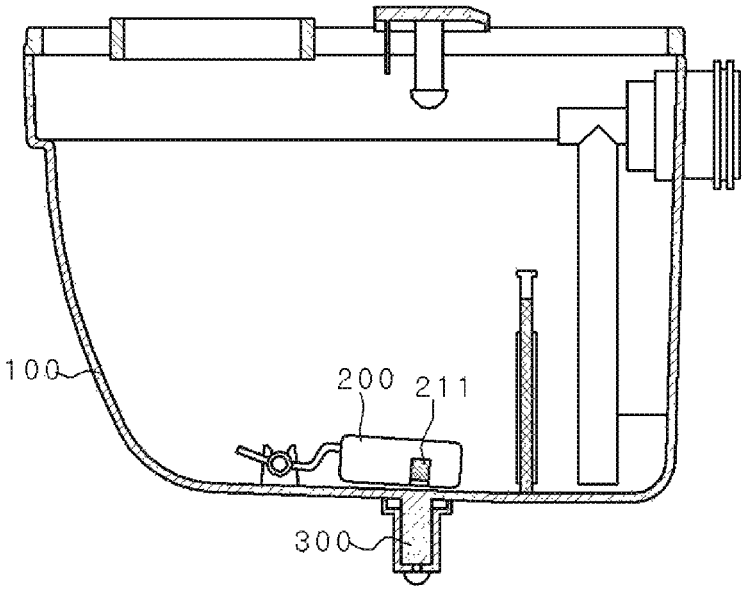

On the other hand, as illustrated in FIG. 8, if the reservoir tank 100 has inadequate liquid additive (less than a prescribed value), the surface level of the liquid additive lowers and the buoyancy body 200 is also lowered. As a result, the magnetic body 211 moves toward the sensor unit 300. The sensor unit 300 senses the magnetic body 211 and sends a signal to the control unit 400. In response to the signal sent from the sensor unit 300, the control unit 400 sends a control signal to the display unit 500 which accordingly notifies a user of the shortage or non-existence of the liquid additive.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A liquid additive supply device for a washing machine, comprising:

a reservoir tank;

a buoyancy body disposed inside the reservoir tank, wherein the buoyancy body is operable to move in accordance with a surface level of a liquid additive contained in the reservoir tank; and a sensor unit disposed inside the reservoir tank, wherein the buoyancy body comprises:

a buoy portion on which the buoyancy force is exerted, the buoy portion comprising a magnetic body disposed therein; and a lever arm coupled to the reservoir tank through a hinge, wherein the hinge is installed on a bottom surface of the reservoir tank and the buoy portion is operable to pivot with the lever arm, wherein one end of the lever arm is connected to the buoy portion and the other end of the lever arm is configured to contact the bottom surface of the reservoir tank, and wherein the sensor unit is configured to sense a magnetic field of the magnetic body to sense approach of the buoyancy body thereto in a non-contact manner.

2. The liquid additive supply device of claim 1, wherein the buoyancy body is installed in a lower portion of the reservoir tank, and wherein a distance between the buoyancy body and the sensor unit varies with the surface level of the liquid additive.

3. The liquid additive supply device of claim 2, wherein the sensor unit is disposed at one side of the reservoir tank in a position facing the buoyancy body.

4. The liquid additive supply device of claim 1 further comprising:

a control unit configured to receive a signal from the sensor unit and to determine a shortage of the liquid additive based on the signal; and a display unit configured to receive a control signal from the control unit and to generate an indication about the shortage of the liquid additive.

5. The liquid additive supply device of claim 4, wherein the display unit comprises at least one of an alarm and a flickering monitor.

6. The liquid additive supply device of claim 1, wherein the buoy portion further comprises:

an air chamber enclosed in the buoy portion and filled with air, wherein the magnetic body is disposed in a position facing the sensor unit and configured to generate a magnetic field.

7. The liquid additive supply device of claim 1, wherein the liquid additive is detergent or fabric softener.

8. A washing machine comprising:

a drum configured to contain a washing object; and a liquid additive supply device configured to supply a liquid additive to the drum and said liquid additive supply device comprising:

a reservoir tank configured to contain the liquid additive; and a buoyancy body disposed in the reservoir tank, wherein a vertical position of the buoyancy body varies with a varying surface level of the liquid additive in the reservoir tank, wherein the buoyancy body comprises:

a buoy portion on which a buoyancy force is exerted, the buoy portion comprising a magnetic body disposed therein; and a lever arm coupled to the reservoir tank through a hinge, wherein the hinge is installed on a bottom surface of the reservoir tank and the buoy portion is operable to pivot with the lever arm, wherein one end of the lever arm is connected to the buoy portion and the other end of the lever arm is configured to contact the bottom surface of the reservoir tank, and wherein the liquid additive supply device further comprises a sensor unit disposed inside the reservoir tank and the sensor unit is configured to sense a magnetic field of the magnetic body to sense approach of the buoyancy body thereto in a non-contact manner.

9. The washing machine of claim 8 further comprising a washing water supply unit configured to supply washing water into the drum, wherein a distance between the buoyancy body and the sensor unit varies in accordance with the surface level of the liquid additive in the reservoir tank.

10. The washing machine of claim 9, wherein the liquid additive is detergent or fabric softener.

11. The washing machine of claim 8 further comprising:

a control unit configured to receive a signal from the sensor unit to determine a liquid additive shortage; and a display unit configured to receive a control signal from the control unit and to generate a notification of the liquid additive shortage.

12. The washing machine of claim 11, wherein the display unit comprises at least one of an alarm and a flickering monitor.

13. The washing machine of claim 8, wherein the buoy portion comprises an air chamber enclosed in the buoy portion and filled with air.

14. The washing machine of claim 8, wherein the reservoir tank comprises multiple compartments.

15. The washing machine of claim 8 further comprising a filter disposed inside the reservoir tank.

* * * * *